United States Patent [19]

Nakashima et al.

[11] Patent Number: 4,938,406

[45] Date of Patent: Jul. 3, 1990

[54] AIR JETTING BOX

[75] Inventors: Hiroshi Nakashima; Masayuki Kawarada; Kiyoshi Okutsu; Sanshiro Fukuhara, all of Kanagawa, Japan

[73] Assignee: Fuji Photo Film Co., Ltd., Kanagawa, Japan

[21] Appl. No.: 232,528

[22] Filed: Aug. 16, 1988

Related U.S. Application Data

[63] Continuation of Ser. No. 5,986, Jan. 21, 1987.

[30] Foreign Application Priority Data

Jan. 21, 1986 [JP] Japan ..... 61-008893

[51] Int. Cl.[5] ..... B65H 20/14

[52] U.S. Cl. ..... 226/97; 226/7

[58] Field of Search ..... 226/97, 197, 7; 34/156, 34/23

[56] References Cited

U.S. PATENT DOCUMENTS

| | | | |
|---|---|---|---|
| 3,957,187 | 5/1976 | Puigrodon | 226/97 X |
| 3,984,039 | 10/1976 | Hawley et al. | 226/97 |
| 4,142,661 | 3/1979 | Nettles et al. | 226/97 |
| 4,394,950 | 7/1983 | Kramer | 226/97 |
| 4,718,178 | 1/1988 | Whipple | 226/97 X |

FOREIGN PATENT DOCUMENTS

| | | | |
|---|---|---|---|
| 2558002 | 7/1976 | Fed. Rep. of Germany | 226/97 |
| 1540415 | 2/1979 | United Kingdom . | |

*Primary Examiner*—Stuart S. Levy
*Assistant Examiner*—Paul T. Bowen
*Attorney, Agent, or Firm*—Sughrue, Mion, Zinn, Macpeak & Seas

[57] ABSTRACT

In a floating type web conveying device, an air jetting box comprises an air jetting surface in which lines of air jetting holes are formed in such a manner that the lines are extended in the widthwise direction of the web and the sum of the areas of the air jetting holes range from 1% to 3% of the area of the air jetting surface, so that the web is substantially free from the difficulty that it is brought into the contact with the air jetting box.

3 Claims, 2 Drawing Sheets

AIR JETTING BOX

This is a continuation of application Ser. No. 005,986, filed Jan. 21, 1987.

BACKGROUND OF THE INVENTION

Field of the Invention

This invention relates generally to a device used in the manufacture of photographing photosensitive materials such as photographing films and print paper, photo-mechanical process materials, magnetic recording materials such as magnetic recording tapes, or recording materials such as pressure-sensitive copying sheets or heat-sensitive copying sheets. The device floatingly supports and dries an elongated belt-like material (hereinafter referred to as "a web") with air streams in such a manner that the belt like material is not in contact with an air jetting box while the web is being conveyed under low tension. The invention relates particularly to the air jetting box.

A device for continuously conveying a web while floating it with air streams is known in the art. The device has a plurality of air jetting boxes which are disposed above and below the web in such a manner that they are extended in the widthwise direction of the web and juxtaposed in the direction of movement of the web. A typical example of the construction of the air jetting boxes is as shown in FIG. 1A. That is, the air jetting box has an air jetting surface 2. Two air jetting slits 3 are formed in two opposite edge regions of the air jetting surface 2 which are extended in the widthwise direction of a web 9. A variety of constructions have been proposed for the air jetting box (cf. Japanese Patent Application (OPI) No. 100388/1984 (the term "OPI" as used herein meaning an "unexamined published applicaiton"), and Japanese Patent Application Publication Nos. 1256/1985, 1257/1985 and 33740/1985).

However, the above-described device is disadvantageous in that, when a web small in thickness is conveyed, when the device is operated with a small air quantity or when the web conveying speed is increased, the amount of floating of the web is greatly affected by variation of the tension of the web, as a result of which the web is liable to contact the air jetting box to form a defective product.

Furthermore, depending on the distance between the air jetting slits 3 of the air jetting box and the quantity of air jetted from the slits 3, the web is curved upwardly as shown in FIG. 1B or downwardly as shown in FIG. 1C, so that the web is creased.

In the conventional air jetting box, in order to make the air jetting condition uniform over the entire length of air jetting slits 3, the slits must be formed with high accuracy and buffer plates should be provided inside the air jetting box 1. Thus, the conventional air jetting box is intricate in construction and high in manufacturing cost.

SUMMARY OF THE INVENTION

Accordingly, an object of this invention is to eliminate the above-described difficulties accompanying a conventional air jetting box.

More specifically, an object of the invention is to provide an air jetting box in which, when the tension of the web changes, the amount of floating of the web is less varied and the web is scarcely brought into contact with the air jetting box. Even when the air quantity is small, the amount of floating of the web above is maintained uniform, and the web is scarcely creased.

Another object of the invention is to provide an air jetting box which, being simple in construction, can be readily manufactured at low cost.

In the air jetting box according to the invention, a number of air jetting holes small in diameter are formed in its air jetting surface in such a manner that the sum of the areas of the air jetting holes with respect to the air jetting surface is small. The air jetting holes are aligned in at least three regions of the air jetting surface, i.e., two opposite edge regions of the air jetting surface and the middle region therebetween.

That is, the foregoing objects and other objects of the invention have been achieved by the provision of an air jetting box in a device for conveying a web while supporting the web with air streams in such a manner that the web is kept floating. According to the invention, the air jetting box comprises an air jetting surface provided in the form of a plate in which a plurality of lines of air jetting holes are formed in such a manner that the lines are extended in the widthwise direction of the web and the sum of the areas of the air jetting holes is from 1% to 3% of the area of the air jetting surface.

In the air jetting box of the invention, its effect can be increased by making the density of the air jetting holes in the two edge regions and the middle region of the air jetting surface at least twice that of the air jetting holes in the other regions.

The nature, principle and utility of the invention will become more apparent from the following detailed description and the appended claims when read in conjunction with the accompanying drawings in which like parts are designated by like reference numerals.

BRIEF DESCRIPTION OF THE DRAWINGS

FIG. 1A is a perspective view of a conventional air jetting box. FIGS. 1B and 1C are explanatory diagrams for a description of the relationships between the air jetting box and the web.

DETAILED DESCRIPTION OF THE INVENTION

Preferred embodiments of this invention will be described with reference to the accompanying drawings.

Figure 2A:
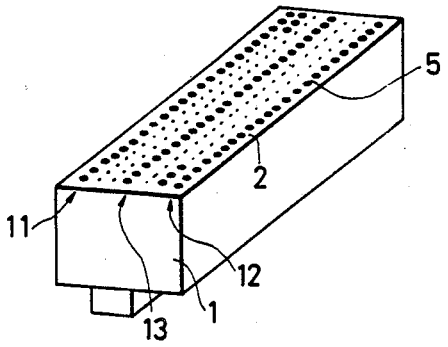
FIGS. 2A and 2B show a first example of an air jetting box according to this invention, more specifically, a perspective view and a sectional side view of the air jetting box of the invention.
Figure 2B:
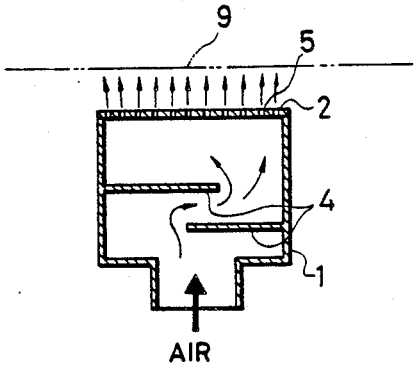

A first example of an air jetting box, as shown in FIGS. 2A and 2B, comprises an air jetting surface 2 which is in the form of a plate. Air jetting holes 5 are formed in a plurality of lines in the air jetting surface 2. The sum of the areas of the air jetting holes 5 with respect to the area of the air jetting surface 2 (hereinafter referred to as "a rate of opening of the air jetting surface 2", when applicable) ranges from 1% to 3% of the air jetting surface 2. It is essential that at least three lines of air jetting holes 5 are formed in both opposite edge regions 11 and 12 of the air jetting surface 2 and the middle region 13 between the edge regions 11 and 12.

In the above-described air jetting box, the plate forming the air jetting surface 2 may be of metal or plastic if the air jetting holes can be efficiently formed in the plate. It is not always necessary that the air jetting surface 2 is flat. That is, the air jetting surface 2 may be somewhat curved as the case may be.

In the above-described air blowing box 1, the air jetting holes 5 are round. However, the round air jetting holes may be replaced by elongated holes which are extended in the direction of width of the web. In this case, it is desirable that the long side of each elongated hole is not more than 80 mm, preferably less than 50 mm (in order to make the internal pressure in the widthwise direction of the web uniform).

As shown in FIG. 2B, an air stream is supplied into the air jetting box from below (it may be supplied thereinto from the side), and the internal pressure is made uniform to some extent by baffle plates 4. When the air is jetted from the box 1, the internal pressure is made substantially uniform by the plate with a number of small holes 5 which form the air jetting surface 2. In the above-described air jetting box 1, the internal pressure is made uniform by the baffle plates 4. However, it should be noted that the internal pressure can be made uniform by other methods. Since the internal pressure has been made uniform as described above, the air streams passing through the air jetting holes 5 of the perforated plate are made uniform in velocity, and accordingly the web is floated uniformly above the air jetting box in the widthwise direction of the web. Furthermore, since the air jetting holes 5 are provided in the entire air jetting surface 2, when the tension of the web changes, the amount of floating of the web if scarcely varied and the web is never creased. Thus, the web is scarcely brought into contact with the air jetting box.

In the conventional air jetting box with the air jetting slits, it is difficult to make uniform the internal pressure distribution in the longitudinal direction of the slits. In order to make the internal pressure distribution uniform, it is necessary to provide dispersion plates or flow straightening boards inside the box. On the other hand, in the air jetting box of the invention, the air jetting surface 2 is provided by the flat perforated plate. Therefore, the air jetting box of the invention is simpler in construction, and is much lower in manufacturing cost.

Figure 3:
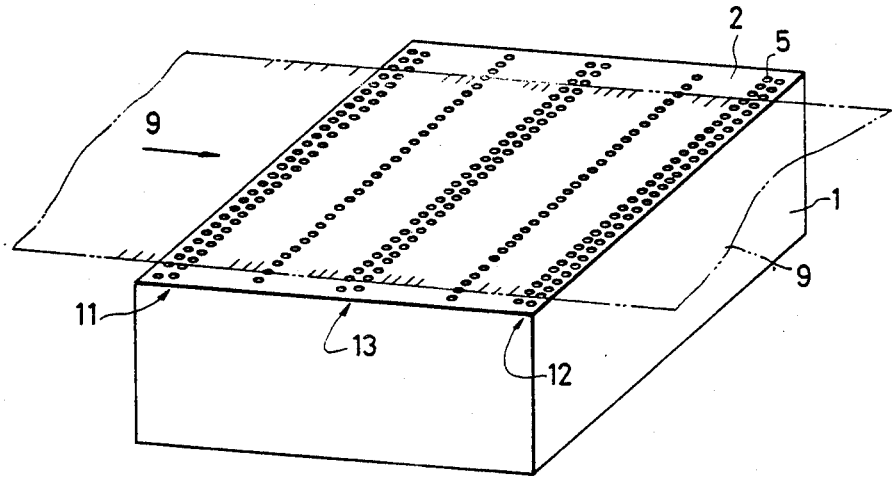
FIG. 3 is a perspective view showing a second example of the air jetting box according to the invention.

FIG. 3 shows a second example of the air jetting box according to the invention. The air jetting box 1 of FIG. 3 is so designed that it uses a lower quantity of air than that of FIG. 2A. Each line of small holes 5 (air jetting holes) in the first example of the air jetting box (FIG. 2A) may be replaced by two lines of smaller holes 5 (air jetting holes) as shown in FIG. 3. Fundamentally, it is desirable that the air jetting holes are as small as possible, preferably 1 to 2 mm in diameter. In the case where the air jetting holes are 1 mm in diameter, as the number of lines of air jetting holes arranged in the widthwise direction of the web is increased the amount of floating of the web is decreased when the tension of the web changes, but the required air quantity is increased. Therefore, in the second example of the air jetting box, as show in FIG. 3 two lines of air jetting holes 5 are formed in each of the two opposite edge regions 11 and 12 of the air jetting surface 2 and in the middle region 13 therebetween. Furthermore, one line of air jetting holes is formed between each these two pairs lines of air jetting holes.

Examples of the web handled by the air jetting box of the invention are webs of paper, plastic film, metal, resin-coated paper, and synthetic paper. The plastic film is made of, for instance, polyolefin such as polyethylene or polypropylene, vinyl copolymer such as polyvinyl acetate, polyvinyl chloride, or polystyrene, polyamide such as 6, 6-nylon or t-nylon, polyester such as polyethylene terephthalate or polyethylene-2,6-naphthalate, or cellulose acetate such as polycarbonate, cellulose triacetate or cellulose diacetate. Typical examples of the resin of the resin-coated paper are polyethylene and polyolefin. However, the resin is not always limited thereto. The metal web may be an aluminum web.

As was described above, in the air jetting box of the invention, the air jetting surface is provided by the plate in which a number of lines of air jetting holes are formed in such a manner that they are extended in the widthwise direction of the web, and the rate of opening of the air jetting surface is as small as 1% to 3%, whereby when the tension of the web changes, the amount of floating of the web is scarcely varied, and no creases are formed on the web above the air jetting box even when the air quantity is small. Since the air jetting surface is provided by the perforated plate, the air jetting box is simpler in construction, and can be readily manufactured, which contributes to a reduction of the manufacturing cost of the air jetting box and accordingly the floating type web conveying device.

In the air jetting box of the invention, the distribution of the air jetting holes in their jetting surface is not uniform. That is, the air jetting holes are concentrated so that the air jetting box operates satisfactorily although both the rate of opening and the necessary air quantity are reduced.

In order to more positively and satisfactorily float the web above the air jetting box, the density of the air jetting holes in the two opposite edge regions 11 and 12 and the middle region 13 of the air jetting surface should be made larger than that of the air jetting holes in the other regions. According to the method, the web can be more positively supported above the air jetting surface with a suitable distance between the web and the air jetting surface. Furthermore, when the tension of the web changes, the amount of floating of the web can be minimized, and the web above the air jetting surface is scarcely creased.

It is desirable that the round air jetting holes are as small as possible. However, it is practical that they are 1 to 4 mm in diameter. The rate of opening of the air jetting surface is preferably 1% to 3% in view of the uniform floating of the web, the required air quantity, and the air supplying equipment.

Figure 4:
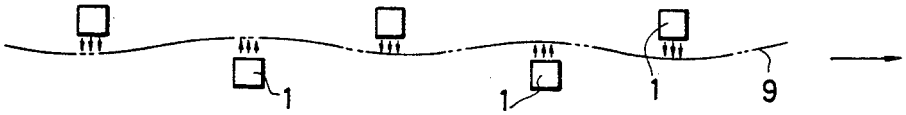
FIG. 4 is a side view showing one example of the arrangement of the air jetting boxes in the web non-contact conveyance.

FIG. 4 is a side view showing one example of the arrangement of the air jetting boxes in the web non-contact conveyance. The air jetting boxes 1 are arranged alternately above and below the web 9 and convey the web 9 in the direction of the arrow while supporting it with air streams in such a manner that it is kept floating.

Figure 1A:
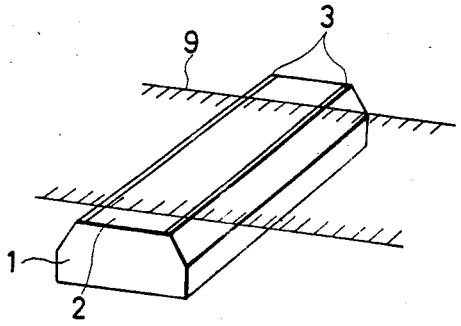
FIG. 1A PRIOR ART
FIGS. 1A, 1B and 1C are explanatory diagrams showing one example of the arrangement of air jetting boxes in a device for conveying and drying a web while supporting it with air streams in such a manner that it is kept floated.
Figure 1B:
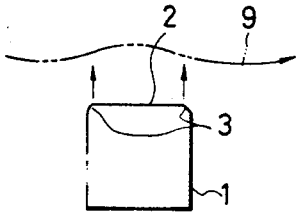
Figure 1C:
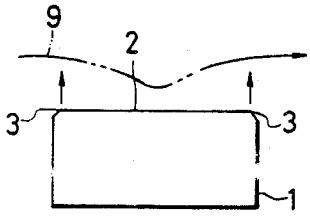

The air jetting boxes of the invention (FIGS. 2A and 3) were arranged as shown in FIG. 4. And the conventional slit type air jetting boxes as shown in FIG. 1A were also arranged in the same manner. Both the conventional jetting box and that of the invention were set to have the same air jetting surface area and air quantity. Under this condition, the variation in the amount of floating of the web caused when the tension of the web changes with the conventional air jetting boxes was compared with the variation in the amount of floating of the web when the tension of the web changes with the air jetting boxes of the invention. The result of comparison is as indicated in the following Table 1:

TABLE 1

| Tension | Amount of floating: Perforated plate of the invention | Amount of floating: Conventional slit type |
|---|---|---|
| 4 kg | 20 mm | 20 mm |
| 12 kg | 16 mm | 11 mm |

As is apparent form Table 1, with the air jetting boxes of the invention, the variation in the amount of floating of the variation in the amount of floating of the web is less.

As was described above, the air jetting box employs the perforated plate to provide the air jetting surface. Therefore, the internal pressure of the air jetting box is positively made uniform in the widthwise direction of the web and the amount of floating of the web in the widthwise direction of the web is also made uniform. Therefore, the invention eliminates the difficulty that when the air quantity decreases, the thickness of the web changes or the conveying speed increases to thereby change the tension of the web, the edges of the web contact the air jetting box.

In the air jetting box, the density of the air jetting holes formed in the two opposite edge regions and the middle region of the air jetting surface are made larger than that of the air jetting holes formed in the other regions. Therefore, the difficulties that the web is supported in wavy form above the air jetting box and the web is creased are substantially eliminated. Accordingly, when the tension of the web changes as was described above, the web is scarcely brought into contact with the air jetting box.

The employment of the air jetting box according to the invention makes it possible to stably convey webs smaller in thickness than that of the conventional air jetting box. The air jetting box of the invention can floatingly support and dry a web with a small quantity of air, which contributes to a reduction of the operating cost.

Since the air jetting surface is provided by employing the perforated plate, the air jetting box of the invention is simpler in construction than the conventional one, and the air jetting box of the invention, unlike the conventional one, has no components which must be formed with high accuracy. Accordingly, even when the ambient temperature of the air jetting box of the invention is high, the effect of the deformation of the box body which attributes to thermal distortion is minimized. In the conventional slit type air jetting box, the slit accuracy should be maintained high when the box is subjected to thermal distortion. However, it is rather difficult to do so.

Instead of the conventional slit type air jetting surface, the air jetting surface in the form of a perforated plate is employed in the air jetting box of the invention. Therefore, the air jetting box of the invention is greatly simplified in construction, with the results that the manufacturing cost of the floating type web conveying device is greatly reduced, and the cost of equipment for the air jetting box of the invention is lower by 30% to 60% than that for the conventional slit type air jetting box.

What is claimed is:

1. An air jetting box for floating a moving web, comprising:

upstanding wall means, and a flat plate having an air jetting surface on top of said upstanding wall means, in which a plurality of lines of air jetting holes are formed in such a manner that said lines are extended in the widthwise direction of said web and the sum of the areas of said air jetting holes is from 1% to 3% of the total area of said air jetting surface, wherein said lines of air jetting holes are formed in both of two opposite edge regions and a middle region therebetween, and wherein there are two of said lines of said air jetting holes in each of said edge regions and said middle region, the distance between two lines in any one region being less than the distance between a line in one of said regions and an adjacent line in an adjacent region.

2. An air jetting box as claimed in claim 1, wherein said air jetting holes have a diameter of approximately 1 mm.

3. An air jetting box as recited in claim 2, further comprising two additional lines of said air jetting holes formed in respective regions between said middle region and said two edge regions.

* * * * *